United States Patent [19]

Peirish

[11] Patent Number: 4,494,257

[45] Date of Patent: Jan. 22, 1985

[54] FLOW CONTROL DEVICE

[76] Inventor: Howard W. Peirish, 9688 Shirley Dr., Allison Park, Pa. 15101

[21] Appl. No.: 482,749

[22] Filed: Apr. 7, 1983

[51] Int. Cl.[3] ..... E04H 3/16

[52] U.S. Cl. ..... 4/508; 4/507; 4/510; 4/512

[58] Field of Search ..... 4/508, 510, 511, 512, 4/507, 509, 494; 210/169

[56] References Cited

U.S. PATENT DOCUMENTS

| | | | |
|---|---|---|---|
| 1,797,397 | 3/1931 | Booraem et al. | 4/511 |
| 2,932,397 | 4/1960 | Ogden | 4/507 |
| 3,059,243 | 10/1962 | Ross et al. | 4/512 |
| 3,155,989 | 11/1964 | Anderson | 4/512 |
| 3,319,264 | 5/1967 | Scarano | 4/512 X |
| 3,363,767 | 1/1968 | Ellis | 4/512 X |
| 3,555,574 | 1/1971 | Stanwood | 4/512 |
| 3,668,713 | 6/1972 | Baker | 4/512 |
| 3,668,714 | 6/1972 | Baker | 4/510 |
| 3,716,873 | 2/1973 | Blum | 4/512 |
| 3,815,161 | 6/1974 | Baker | 4/512 |
| 3,939,505 | 2/1976 | Gross | 4/512 |
| 4,112,526 | 9/1978 | Patterson | 4/509 |
| 4,121,307 | 10/1978 | Patterson | 4/494 |
| 4,146,937 | 4/1979 | Baker | 4/508 X |

*Primary Examiner*—Henry K. Artis
*Attorney, Agent, or Firm*—Stephen F. K. Yee

[57] ABSTRACT

A control device for regulating the skimming flow of surface water from a swimming pool to a perimeter gutter includes a housing disposed in a gutter wall, at the normal level of water in the pool, which defines a flow passage from the pool to a lower gutter trough. A plate pivotally supported within a downwardly-sloped portion of the flow passage reduces flow through the housing in response to increasing levels of water in the trough. The plate closes the flow passage when the water in the trough exceeds a predetermined level to prevent flooding of the gutter and to prevent back flow of water from the gutter to the pool.

25 Claims, 2 Drawing Figures

FLOW CONTROL DEVICE

BACKGROUND OF THE INVENTION

1. Field of the Invention

This invention relates generally to the water circulation system of a swimming pool and is more particularly directed to a flow control device for use in a surface skimmer incorporated in the gutter disposed around the perimemter of the pool.

2. Description of the Prior Art

There are generally two methods used to remove dirt, debris and other foreign matter from the surface of the water in a swimming pool. One method is to provide surface skimmers spaced along the periphery of the pool wall. Each surface skimmer includes an opening in the pool wall, generally at the height of the normal level of the water in the pool, connected to the circulation system of the pool which may include conduits leading to a filter and a pump to recirculate the water. The inlet of the opening is generally provided with a weir to control the flow of water through the skimmer. The weir is installed such that when the circulation system is operating to produce skimming, it is deflected inwardly from the inlet opening to permit the rapid flow of the surface layer of water over the top edge of the weir, and to close the opening when skimming is stopped. When the weir is in its closed position, it serves as a barrier against a return to the pool of debris within the skimmer conduit. The weirs are generally buoyant structures mounted to permit deflection about a lower edge, and examples of such weirs may be found in U.S. Pat. Nos. 3,555,574, 3,716,873, 3,815,161 and 3,939,505.

Another method for removing foreign matter from the surface of the pool water is to provide a continuous gutter around the periphery of the pool in which water continually flows over the top of the gutter wall into a lower-level gutter trough. Such gutter designs are exemplified in U.S. Pat. Nos. 1,797,397 and 2,932,397. While such gutter designs provide sufficient skimming under normal flow conditions, heavy surges or waves produced by large number of swimmers or high level of activity within the pool increases the flow of water over the gutter and tends to flood the gutter, stopping any skimming action until the water is drained and often washing the dirt already in the gutter back into the pool.

Attempts have been made to resolve these and other difficulties associated with the perimeter gutter design, and to combine the advantages of the suface skimmer design with the perimeter gutter design. Examples may be found in U.S. Pat. Nos. 3,319,264, 3,363,767, 3,155,989, 3,668,713, 3,668,714, 4,112,526, 4,121,307 and 4,146,937. In the patent to Scarano (3,319,264), a trough extending around the perimeter of the swimming pool is provided with openings through which the water spilling over the lip of the wall flows through an enclosed passage to the water filter. In one embodiment, hinged flaps close the openings of the trough to prevent back flow of water if the level of the water within the passage exceeds the height of the openings.

The other patents incorporate weir skimmers in the wall of the gutter facing the pool. Ellis (U.S. Pat. No. 3,362,767) provides a manually-controlled flap gate to close the opening to the weir. In the patent to Anderson (U.S. Pat. No. 3,155,989), a gate made of a buoyant material is hinged at its lower edge to control the flow of water through the skimmer. The opening of the gate is dependent upon the quantity of water in the gutter which, in turn, is controlled by the positioning of baffle plates across the width of the gutter. In the Patterson U.S. Pat. Nos. 4,112,526 and 4,121,307, the flow of water through the skimmer openings are controlled by float-actuated closures which respond to the level of the water in the gutter to shut off flow through the skimmer openings. In the patents to Baker (U.S. Pat. Nos. 3,668,713 and 3,668,714), hinged, counter-weighted control plates respond to the level of the water in the pool to shut off flow through the weir opening.

The flow control devices utilized in the surface skimmers of the prior art exhibit problems. The devices which utilize floats can hang up due to debris getting caught between the float and the sidewalls of the skimmer housing, thus allowing water to continually spill pass. Flow control devices which incorporate spring-biased movable plates are subject to being jammed in either the open or close position. Plates which incorporate weights for counterbalance require adjustment of the weights for proper operation. Similarly, weighted butterfly-type plates disposed at the water line tend to chatter and otherwise create disturbing noises under the action of waves when they open and close.

SUMMARY OF THE INVENTION

Accordingly, it is an object of the present invention to provide an improved flow control apparatus for use with surface skimming devices in swimming pools, and particularly for surface skimming devices used in conjunction with a perimeter gutter type water circulation system.

Another object of the invention is to provide an improved flow control apparatus of the foregoing type which is effective, reliable and quiet in operation and requires minimum maintenance.

Another object of the present invention is to provide an improved flow control apparatus of the foregoing type which provides continuous skimming of the surface of the pool water, and responds to the quantity of water in the gutter to regulate skimming flow.

A further object of the present invention is to provide an improved flow control apparatus of the foregoing type which is responsive to periods of surge and wave activity in the pool resulting in excessive flow in the gutter to completely stop skimming action.

Yet another object of the present invention is to provide an improved flow control apparatus of the foregoing type which is effective to prevent back flow of water from the gutter to the pool at any flow level within the gutter.

In accordance with the invention, the foregoing and other objects are obtained in an apparatus for controlling the skimming flow of surface water from the pool into a perimeter gutter. The apparatus includes a skimmer housing disposed within a cut-out on the gutter wall facing the pool and defining a flow passage from an elevation substantially equal to the normal water level in the pool to a gutter trough which is at a lower elevation. The skimmer housing is formed by parallel upper and lower plates secured to end plates, with the inlet covered by a slotted cover plate and the elongated outlet disposed above the surface of the gutter trough. Each of the upper and lower plates is formed to define a horizontally portion of the flow passage adjacent the inlet and a sloped portion inclined downwardly at a predetermined angle and leading to the outlet. A control plate is pivotally supported at its upper ends within the sloped portion of the flow passage and coacts with the lower plate to reduce flow through the housing in response to an increasing level of water in the gutter trough. Zero or very low levels of water within the gutter permits maximum skimming flow through the housing, with the flow decreasing as the level of water in the gutter increases, to the point in which an excessive level of water in the gutter resulting from high pool activity causes the control plate to completely close the flow passage, thereby preventing backflow of water from the gutter into the pool.

The foregoing description, as well as further objects, features and advantages of the present invention, will be more fully appreciated by reference to the following description of a presently-preferred but nonetheless illustrative embodiment in accordance with the invention and the accompanying drawings.

DESCRIPTION OF THE PREFERRED EMBODIMENT

Figure 1:
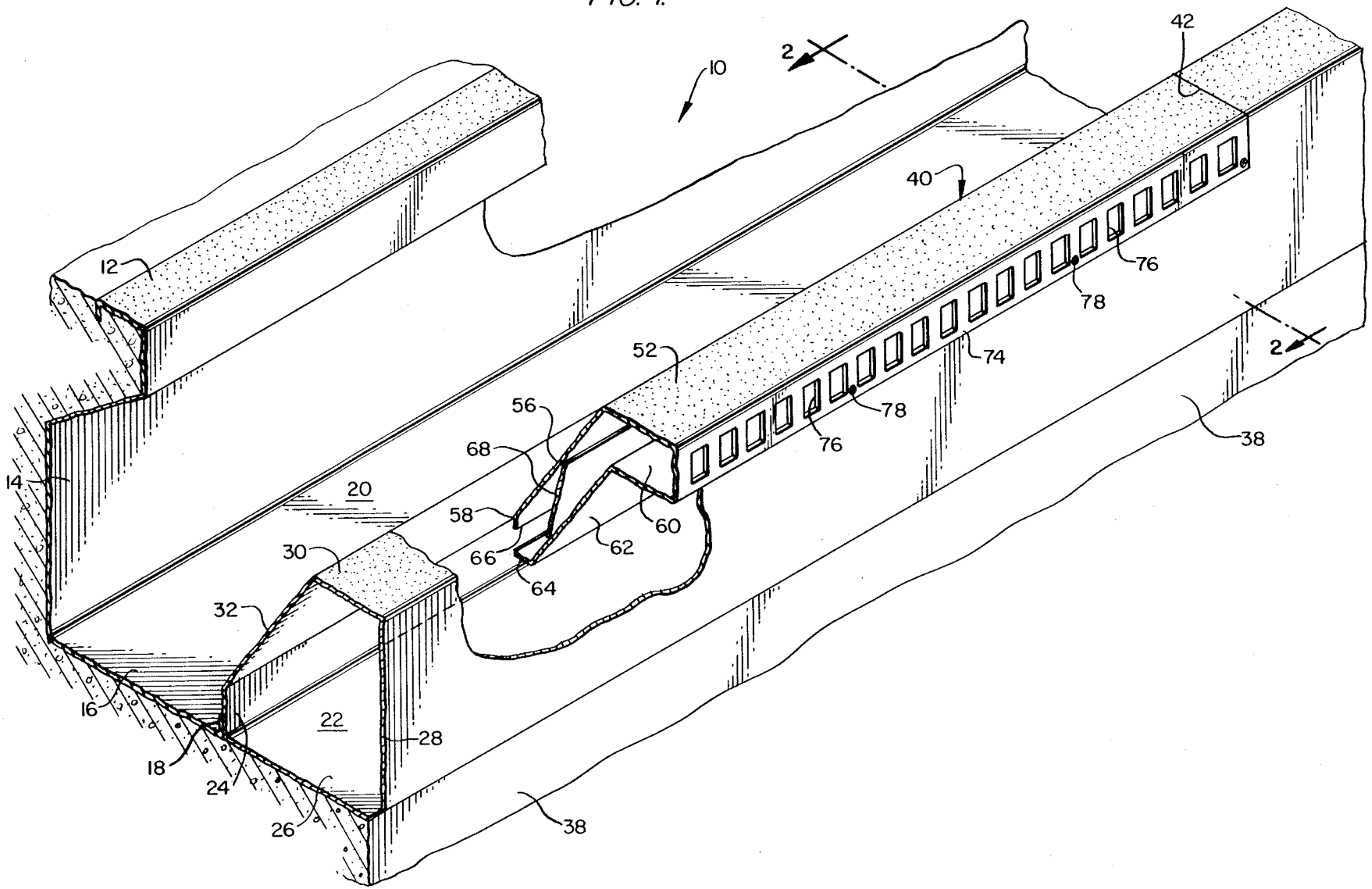
FIG. 1 is an isometric view, partially in section, of a portion of a swimming pool gutter incorporating the skimmer and flow control device of the present invention.

Referring now to FIG. 1 of the drawings, a section of a gutter 10 incorporating the skimmer flow control device of the present invention is shown installed around the upper periphery of a swimming pool, and includes a coping 12 substantially flushed with the horizontal edge of the pool. A vertical back wall 14, a horizontal bottom 16 and a front flange or lip 18 form an open gutter trough 20. Attached to the gutter 10 is a recirculation tube 22, a conduit through which fresh and filtered water is provided to the pool, which is formed with a back, vertical flange 24, a bottom 26, a vertical front wall or face 26, a horizontal top 30 and a sloping back wall 32 joined to the edge of the back flange. The surfaces of the coping 12 and the top 30 may be provided with a non-skid covering, and the open gutter trough 20 may be covered with a perforated grating (not shown).

Figure 2:
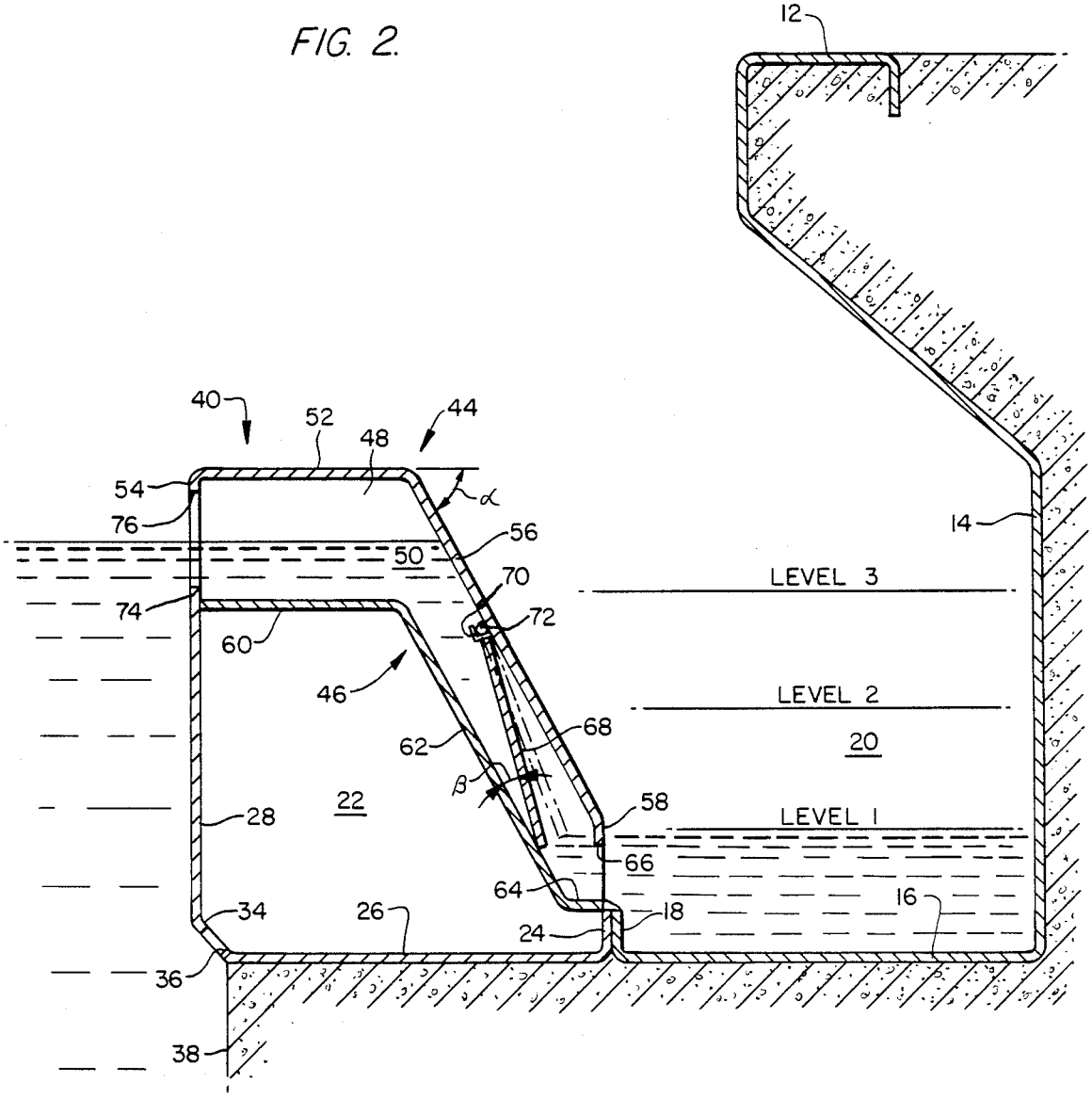
FIG. 2 is a cross-sectional view as seen along line 2—2 in FIG. 1.

Partially visible in FIG. 1 and more clearly shown in FIG. 2 is an inclined portion 34 of the bottom 26 in which a plurality of holes 36 are spaced through which water is introduced into the pool. As shown in the drawings, the recirculation tube 22 may be conveniently formed of a single sheet of material which is bent into the configuration shown. Similarly, the gutter trough 20 may be formed of sheet material bent into the configuration shown, and joined to the recirculation tube 22 by any suitable means, such as by welding along the flanges 18 and 24. The assembled gutter 20 and recirculation tube 22 is installed around the perimeter of the pool such that the inclined wall portion 34 with the holes 36 is disposed adjacent to the upper edge of the wall 38 of the pool, as shown in FIG. 2.

A surface skimmer or skimming device 40 is fitted within a recess or cutout 42 provided in the recirculation tube 22, such as shown in FIG. 1, and is secured therein by any suitable means. The external configuration of the skimmer 40 is such that when installed its external surfaces have substantially the same cross-sectional configuration as the recirculation tube 22 and fit flush therewith. The housing of the skimmer 40 includes an upper plate 44 and a lower plate 46 which are disposed in spaced-apart parallel relationship and joined at their longitudinal ends by end plates 48 to form a flow chamber or passage 50 through the skimmer. As shown in FIG. 2, the upper plate 44 is formed with a horizontal portion 52 with a downwardly-depending flange 54 at its front edge and a rear, downwardly-sloped portion 56 which terminates in a vertical flange 58 at its lower edge. The lower plate 46 is similarly formed with a horizontal portion 60, a rear, downwardly-sloped portion 62 which extends into a horizontal flange or lip 64 disposed below the vertical flange 58 to provide a discharge opening 66 which extends substantially the length of the skimmer 40. A control plate or check valve 68 extends substantially the length of the skimmer 40 and discharge opening 66 and is pivotally supported at its upper ends, such as by pivotal hooks 70 secured on the sloped wall portion 56 or the end plates 48 received within notches or cut outs 72 provided at the upper corners of the control plate.

The sloped portion 56 of the upper plate 44 is inclined downwardly at a specified angle $\alpha$ relative to the horizontal portion 52, such as $61\frac{1}{2}$ degrees. Similarly, the sloped wall portion 62 of the lower plate 46 is downwardly inclined relative to the horizontal portion 60 by a similar inclination. With the plates 44 and 46 disposed in parallel, and with the pre-determined angular inclination of the sloped wall portions 56, 62 relative to the horizontal portions 52, 60, the control plate 68 swings freely about the pivotal hooks 70, and under its own weight its lower edge engages the sloped portion 62 of the lower plate 46.

A cover plate 74 having a plurality of vertically-elongated slots or openings 76 is secured to the face flange 54 of the skimmer 40 by any suitable means, such as corrosion-resistant screws 78. Alternatively, the upper plate 44 and lower plate 46 may be formed from a sheet of flat material, with the slots 76 pre-formed and bent into the configuration substantially as shown in FIG. 2. The separate end plates 48 are then secured to the ends of the upper and lower plates 44, 46. The slots 76 function as weirs for the flow of surface pool water entering the skimmer 40. By way of illustration, the structural components described are fabricated of any suitable material which is sturdy and corrosion resistant, such as stainless steel or plastic.

The flow chamber 50 of the skimmer 40 has a horizontally-extending portion adjacent to the inlet closed by the perforated cover plate 74, which is contiguous with a downwardly-sloped portion terminating in an outlet at a lower elevation than the inlet. As configured a continuous skimming flow passes through the flow chamber 50 and the angularly-disposed control plate 68, in cooperation with the sloped wall portion 62, functions as a one-way check valve.

The angle of the downward inclination of the flow chamber 50 defined between the plate portions 56, 62 and the height of the control plate 68 are such that when the lower edge of the control plate contacts the plate portion 62, the control plate is disposed at an angle relative to the vertical, defining an acute angle $\beta$ between the control plate and the lower plate portion 62 (FIG. 2). Thusly disposed, the control plate 68 provides minimum resistance to the skimming flow through the passage 50, but is sufficiently sensitive to the water level in the trough 20 to control the skimming flow.

Closing of the flow chamber 50 by the control plate 68 is effected only by the rise and fall of water in the gutter trough 20. At water level 1 within the gutter trough 20, the resultant pressure does not prevent the opening of the control plate 68 due to the skimming flow. Thus, the control plate 68 can be fully opened and skimming action produced by the flow of surface water through the openings 76 in the cover 74 is at its maximum. As the water rises in the gutter trough 20 to level 2 due to increased activity in the pool, for instance, the turbulence at the discharge opening 66 from the water passing from the flow chamber 50 into the gutter trough and the increasing pressure due to the rising water level in the trough causes the control plate to start closing to reduce flow through the skimmer 40. During times of great activity in the pool, large amounts of water will spill over the top of the recirculation tube 22 and raise the water within the gutter trough 20 to level 3. At level 3, the water in the gutter trough 20 is above the horizontal level of the pivotal hooks 70 so that the pressure of the water acts upon the entire back surface of the control plate 68. At this point, the control plate 68 will close the flow chamber 50 completely to prevent further flow through the skimmer 40. By way of illustration, the water levels 1, 2 and 3 within the gutter trough 20 may be at incremental heights of approxiamtely 1.5 inches. Thus, at level 1 there is 1.5 inches of water within the trough; at level 2 there is approximately 3 inches of water; and at level 3 approximately 4.5 inches of water is in the trough.

The height of the control plate 68 and the vertical location of the pivotal hooks 70 are appropriately selected so that when the flow through the chamber 50 is completely shut, the level of water in the trough 20 is less than the gutter depth to provide ample capacity to accommodate surges and waves flowing over the top of the recirculation tube 22 without flooding the gutter 10.

The skimmer 40 forms an integral part of the structure of the recirculation tube 22 and is positioned with its inlet opening below the top 30 of the recirculation tube, at the normal operating water level of the pool, as shown in FIG. 2. The face 28 of the recirculation tube 22 functions as a dam and prevents water from spilling into the gutter during normal levels of activity in the pool. The skimmer 40 is designed to skim continuously the surface water of the pool and to automatically shut off skimming flow to prevent flooding the gutter.

In operation, the control plate 68 regulates the water flow through the chamber 50 according to the depth of water in the gutter trough 20, in the manner describer above. As the water in the gutter trough 20 rises, the pressure of the increasing height of water forces the lower, free edge of the control plate 68 against the surface of the sloped wall portion 62 of the lower plate 46, thus decreasing the flow through the chamber to slow down the skimming action and prevent flooding of the gutter. As the water in the gutter rises higher due to surges of water or waves flooding over the gutter wall, the control plate 68 will completely close off the flow chamber 50 to prevent flooding of the gutter which may result from water continuing to flow through the skimmer 40 into a full gutter, and to prevent back flow of water into the pool from the gutter through the skimmer.

The gutter 10 may be preformed in any convenient length, with the individual lengths being joined in situ during construction of the swimming pool. The length of gutter trough 20 may be fabricated separate from the length of recirculation tube 22 and joined together at the construction site, or these two units may be fabricated as a joined unit in any convenient length, and the lengths joined on the site. The skimmer 40 is located along the perimeter of the gutter 10 at spacings determined by the capacity of the pool and the requirements of the quantity of water which is to be skimmed, filtered and recirculated.

The skimmer of the present invention may be installed in the recirculation tube during fabrication of the tube and gutter structures. Alternatively, the skimmer may be retrofitted into an existing perimeter gutter system by providing a suitable recess for the skimmer housing in the gutter wall and installing the skimmer. It is understood that it is not necessary for the skimmer to be incorporated into a recirculation tube or conduit in order to function properly. The modular skimmer housing with its self-contained flow control plate may be installed directly in the pool-side wall of the gutter to provide controlled skimming flow into the lower-level gutter trough.

It is understood that all structure necessary to form a complete, operative system has not been included in the foregoing description. Such complementary structure is known and would be provided by a person skilled in the art. Numerous modifications and variations of the present invention are possible in light of the above disclosure. It is therefore to be understood that within the scope of the appended claims the invention may be practiced otherwise than as specifically described herein.

I claim:

1. A skimming device for removing water from the surface of a swimming pool, said pool including a gutter conduit having a trough disposed at an elevation lower than the normal level of the water in the pool, said gutter having a pool-side wall with an upper edge disposed above the normal level of the water in the pool, the device comprising:

a housing in said gutter wall defining a flow passage with an inlet opening into the pool and an outlet opening into the gutter trough, said passage having a downwardly-inclined portion adjacent to said outlet; and a plate pivotally disposed within said inclined portion of the passage such that under its own weight the lower edge of the plate contacts the lower surface of said passage a control the flow through said passage, said plate responsive to the level of water within the trough to reduce flow through said passage and to stop flow through said passage when the level of water in the trough exceeds a predetermined height.

2. A skimming device as set forth in claim 1, wherein said plate is pivotally disposed at an angle relative to a vertical axis through said inclined portion of the flow passage with the plate closing the passage.

3. A skimming device as set forth in claim 1, wherein said passage further includes a substantially horizontally-disposed portion adjacent to said inlet.

4. A skimming device as set forth in claim 1, wherein said flow passage is formed by the upper and lower surfaces of said housing, and said housing further includes end surfaces to form an enclosing chamber.

5. A skimming device as set forth in claim 4, wherein said upper and lower housing surfaces each are configured to have a substantially horizontal portion disposed adjacent to the inlet opening and an inclined portion disposed adjacent to the outlet opening, and are disposed in a spaced, parallel relationship to define said flow passage.

6. A skimming device as set forth in claim 5, wherein the inlet of said flow passage is provided with a cover perforated to permit controlled flow of water into said passage from the pool.

7. A skimming device as set forth in claim 5, wherein said plate is pivotal about an upper edge and the lower edge of said plate cooperates with the inclined portion of said lower housing surface to control water flow through said passage.

8. A skimming device as set forth in claim 5, wherein the inclined portion of each of said upper and lower housing surfaces is oriented at a predetermined angle relative to the substantially horizontal portion of each of said surfaces.

9. A system for removing the water from the surface of a swimming pool comprising, in combination:

a conduit for disposition about the perimeter of the swimming pool and adapted to carry water at a level below a predetermined level of water in the pool;

a retaining wall on the pool side of said conduit, the upper edge of said wall being disposed above the predetermined level of water in the pool, over which edge water may flow from the pool into said conduit; and a skimming device having an inlet opening in said retaining wall disposed below the upper edge of said wall, at substantially the predetermined level of water in the pool; a housing defining a flow passage from said inlet to an outlet opening into said conduit, said passage having a downwardly-inclined portion adjacent to said outlet; and a plate pivotally disposed within said inclined portion of the passage such that under its own weight the lower edge of the plate contacts the lower surface of said passage to control the flow of water through said passage, said plate responsive to the level of water within said conduit to reduce flow through the passage and to stop flow through the passage when the level of water in said conduit exceeds a predetermined height.

10. A system as set forth in claim 9, wherein the flow passage in said skimming device further includes a substantially horizontally-disposed portion adjacent to said inlet.

11. A system as set forth in claim 10, wherein the inclined portion of the passage is disposed at a predetermined angle relative to the horizontally-disposed portion.

12. A system as set forth in claim 11, wherein said housing comprises parallel-disposed upper and lower surfaces and parallel-disposed end surfaces joined to said upper and lower surfaces and said flow passage is defined within said housing by said adjoined surfaces.

13. A system as set forth in claim 12, wherein said upper and lower surfaces are each formed with a horizontally-disposed portion adjacent the inlet and a downwardly-inclined portion adjacent the outlet, said inclined portion being disposed at a predetermined angle relative to said horizontal portion.

14. A system as set forth in claim 13, wherein said plate is disposed to pivot substantially about the upper edge and coacts with the inclined portion of said lower surface to control flow through said passage.

15. A system as set forth in claim 12, including a perforated cover for said inlet, the mid-height of said perforations being disposed substantially at the predetermined level of water in the pool, said perforations functioning as weirs to accelerate the flow of the surface layer of pool water into said passage.

16. A system as set forth in claim 12, further including a second conduit disposed adjacent to said conduit to provide water to the swimming pool.

17. A system as set forth in claim 16, wherein said second conduit is an enclosed conduit having a pool-side wall forming said retaining wall and an upper surface over which water may flow from the pool into said conduit, and said housing is disposed in a cutout provided in said second conduit.

18. A system as set forth in claim 17, wherein the upper surface of said housing conforms to and is substantially flush with the external shape of said second conduit.

19. In combination, a swimming pool having generally vertical walls to contain a body of water to a predetermined height; a first conduit disposed about the upper periphery of said walls and adapted to carry water at a level lower than the level of water in the pool; a pool-side wall of said first conduit having an edge disposed above the predetermined height of water in the pool, over which edge water may flow from the pool into said first conduit; and a skimming device having a flow passage with an inlet opening into the pool-side wall of said first conduit, at a level substantially equal to the predetermined height of water in the pool, and an outlet opening into said first conduit, said passage having a downwardly-inclined portion adjacent to said outlet, and a plate pivotally disposed within said inclined portion of the passage to have its lower edge contact under the plate's own weight the lower surface of the passage and responsive to the level of water in said first conduit to control the flow of water through said passage.

20. A combination as set forth in claim 19, wherein said passage further includes a substantially horizontally-disposed portion adjacent to said inlet.

21. A combination as set forth in claim 20, wherein said skimming device includes a housing having generally parallel, spaced upper and lower surfaces and end surfaces adjoined to define said flow passage, each of said upper and lower surfaces having a substantially horizontal portion disposed adjacent to the inlet opening and an inclined portion disposed at a predetermined angle relative to said horizontal portion to form said respective horizontal and inclined portions of said passage.

22. A combination as set forth in claim 21, wherein said plate is pivotal substantially about an upper edge and coacts with the inclined portion of said lower housing surface to control the flow of water through the passage.

23. A combination as set forth in claim 22, wherein said housing further includes a perforated cover over said inlet, the mid-height of the perforations being disposed substantially at the predetermined level of water in the pool, said perforations functioning as weirs to accelerate the flow of the surface layer of pool water into said passage.

24. A combination as set forth in claim 22, further including a second, enclosed conduit disposed adjacent to said first conduit to provide water to the pool.

25. A combination as set forth in claim 24, said second conduit having a pool-side wall forming a retaining wall for the water in the pool and a top wall disposed above the predetermined height of the water in the pool, over which top wall water may flow from the pool to said first conduit, and said skimmer housing is disposed in a cutout provided in said second conduit, the external configuration of said housing being complementary with the external configuration of said second conduit.

* * * * *

UNITED STATES PATENT AND TRADEMARK OFFICE

CERTIFICATE OF CORRECTION

PATENT NO. : 4,494,257

DATED : January 27, 1985

INVENTOR(S) : Howard W. Peirish

It is certified that error appears in the above—identified patent and that said Letters Patent is hereby corrected as shown below:

Column 6, line 47, "a control the flow" should read --to control the flow--.

Signed and Sealed this

*Second* Day of *July 1985*

[SEAL]

*Attest:*

DONALD J. QUIGG

*Attesting Officer*

*Acting Commissioner of Patents and Trademarks*